United States Patent [19]

Wattenbarger

[11] 4,373,521

[45] Feb. 15, 1983

[54] HEATED BREATHING BAG SHEATH

[75] Inventor: J. Frank Wattenbarger, Panama City, Fla.

[73] Assignee: The United States of America as represented by the Secretary of the Navy, Washington, D.C.

[21] Appl. No.: 295,398

[22] Filed: Aug. 24, 1981

[51] Int. Cl.[3] ..... A62B 7/00

[52] U.S. Cl. ..... 128/202.13; 128/204.17; 165/64

[58] Field of Search ..... 128/201.27, 204.17, 128/202.13; 165/64

[56] References Cited

U.S. PATENT DOCUMENTS

| | | | |
|---|---|---|---|
| 1,132,138 | 3/1915 | Whitney . | |
| 1,213,160 | 1/1917 | Davis . | |
| 3,105,708 | 10/1963 | Esty | 285/41 |
| 3,449,761 | 4/1967 | Long | 2/2.1 |
| 3,865,106 | 2/1975 | Palush | 128/145.8 |
| 3,898,978 | 8/1975 | Marcus | 126/204 |
| 4,013,122 | 3/1977 | Long | 165/154 |
| 4,014,384 | 3/1975 | Marcus | 165/104 S |
| 4,168,706 | 9/1979 | Fletcher | 128/142 R |
| 4,197,841 | 4/1980 | Brauer et al. | 128/204.26 |

*Primary Examiner*—Henry J. Recla

*Attorney, Agent, or Firm*—Robert F. Beers; Harvey A. David

[57] ABSTRACT

A sheath device for heating breathing bags and hoses of underwater breathing apparatus employs a fabric enclosure for the breathing bags, walls of which enclosure are formed of two layers sealed together at a plurality of discrete points to define water passages within sealed boundary lines. Tubular water conducting enclosures for the breathing hoses are connected to the enclosures in communication with the water passages in the walls, and flexible tubular dams connected to the device and to the hoses direct water flow from the wall passages into the hose enclosures.

10 Claims, 7 Drawing Figures

HEATED BREATHING BAG SHEATH

BACKGROUND OF THE INVENTION

This invention relates generally to the field of underwater breathing apparatus for divers, and more particularly to a heated sheath device for improving the operation and duration and comfort in use of diving apparatus of the type comprising a $CO_2$ (carbon dioxide) scrubbing cannister, one or more breathing bags, and flexible hoses for conducting breathing gas between the diver and the breathing bag or bags.

Diving apparatus of the foregoing type, usually of closed or semiclosed circuit configuration, suffer from considerable heat loss when operated at considerable depths (such as require a mixed gas breathing medium) and water temperatures of, say, 30° F. Inasmuch as efficient $CO_2$ scrubbing is dependent on favorable conditions of temperature and humidity, the results of the heat loss, experienced largely by conduction of thermal energy through the breathing bag walls, hose walls, and scrubber cannister to surrounding water, are manifested in diver discomfort and in shortened dive duration because of the $CO_2$ absorbent bed not being fully used.

Heat losses from the cannister walls have been offset through the use of a water heated cannister described in U.S. Patent Application, Ser. No. 06/227,285, filed Jan. 22, 1981, and assigned to the assignee hereof. The heat losses through the breathing bag and hose walls are addressed by this invention.

SUMMARY OF THE INVENTION

With the foregoing in mind, it is a principal object of this invention to provide a means for utilizing hot water to heat the flexible breathing bags and hoses of an existing underwater breathing apparatus without change in the breathing bag or hose design.

Another, and important object is the provision of a water heated sheath device as an accessory that can be installed and removed with little expenditure of time or effort and which interferes little with maintenance and servicing of the breathing apparatus.

Still another object is to provide a heated breathing bag sheath that is light in weight, economical to produce, efficient and reliable in operation, and which can be configured for use with any of a variety of breathing apparatus having breathing bag means exposed to ambient water and having a source of hot water.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 4:
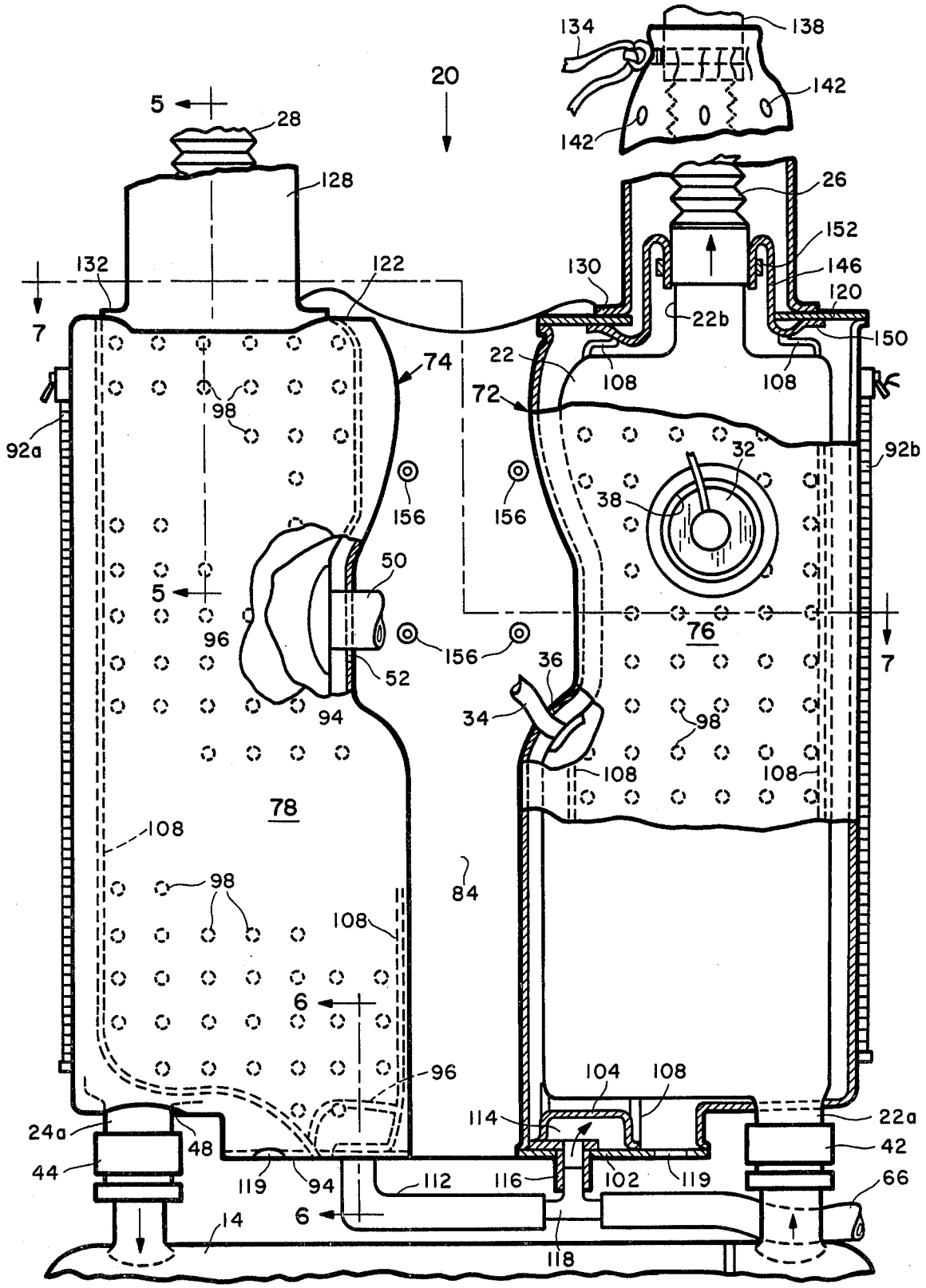
FIG. 4 is an enlarged front view of the sheath device in association with breathing bags and hoses, and with portions broken away or in section.

Referring to the drawings, an underwater breathing apparatus of the semi-closed circuit type is indicated generally at 10 and comprises a rigid housing or shell 12 within which are mounted the various apparatus components. The shell is fitted with suitable straps so as to be worn as a back pack and houses a $CO_2$ scrubber canister 14, of the type described in the aforementioned application, emergency breathing gas flasks 16 and 18, and a pair of vertically elongate, generally rectangular breathing bladders or bags disposed within a heated breathing bag sheath indicated generally at 20. The breathing bladders or bags, indicated at 22, 24 of FIG. 4, are formed of flexible rubber and serve to accommodate volumetric changes in the system resulting from inhalation and exhalation, respectively, of the user through flexible supply and return hoses 26 and 28 when connected to a users mask or helmet (not shown). The breathing bags 22, 24 are conveniently formed with inlet and outlet passage defining necks **22*a*, 22*b*, 24*a*, and 24*b*.**

Also mounted in the shell 12 are a makeup gas control valve 30, which is responsive to an oxygen partial pressure sensor 32 to meter an oxygen enriching gas mixture via tube 34 into the inhalation bag 22 as necessary to maintain the correct oxygen partial pressure conditions for the depth concerned. The tube 34 and the sensor are connected to the bag 22 at locations in registration with openings 36 and 38, respectively, in the sheath device 20.

The necks **22*a*, 24*a*, at the lower ends of the inhalation and exhalation breathing bags 22,24 are provided with couplings 42,44, respectively, by which they are connected to opposite ends of the $CO_2$ scrubber canister 14 through which exhaled gas passes from the bag 24 to the bag 22 for reuse. The necks 22*a*, 24*a* extend through corresponding openings 46, 48 in the sheath 20. The bag 24 is further provided with an excess gas outlet 50 passing through an opening 52 in the sheath device 20 and connected to an excess gas discharge or exhaust valve 54 that is adapted to vent excess gas via port 56 in the rear of shell 12**.

Also mounted in the shell 12 is a hot water distribution block 60 that receives hot water via a tube 62 and a hose 64 from multiple conduit umbilical (not shown) through which the diver receives primary life support. The water distribution block 60 is internally ported to divide the hot water supply such that two thirds goes through the $CO_2$ scrubber canister 14 and then via a tube 68 and hose 70 to the heating passages of the diver's suit, while the other third is fed via a tube 66 directly to the sheath device 20.

In accordance with the present invention, the sheath device 20 is formed of flexible fabric and is generally configured to follow the shape of the breathing bag or bags to be heated. Thus, in the present example, the sheath device 20 comprises first and second generally rectangular, breathing bag enclosures or sections 72 and 74 that adapted to encase the breathing bags 22 and 24 respectively. The sections 72 and 74 comprise front walls 76 and 78 and rear walls 80 and 82. The sections are joined in laterally spaced relation by a fabric web 84. The front and rear walls 76,80 of section 72 are interconnected by inner and outer side walls 86 and 88, while the front and rear walls 78, 82 of section 74 are interconnected by inner and outer side walls 90 and 92. In order to facilitate assembly of the sheath device 20 on the breathing bags 22, 24, the outer side walls 88 and 92 are provided with longitudinal openings that are adapted to be closed with slide fasteners 88*a* and 92*a*.

Figure 6:
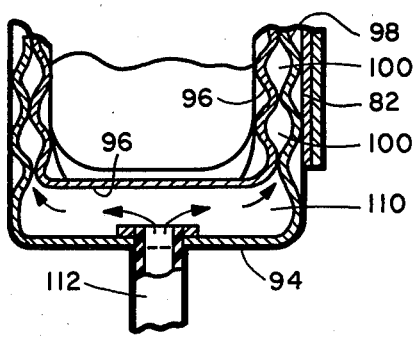
FIG. 6 is a fragmentary view taken along line 6—6 of FIG. 4.

As is best illustrated in FIGS. 4 and 6, the front and rear walls 78,82 are formed of an outer layer 94 and an inner layer 96. These layers are formed of a waterproof, substantially impervious fabric such as urethane coated nylon cloth material and are sealed together at locations in a pattern of dots 98, as is best shown in FIG. 4. The pattern of dots 98 allows the layers to spread between the dots to define interconnected water passages 100 between the layers.

Figure 7:
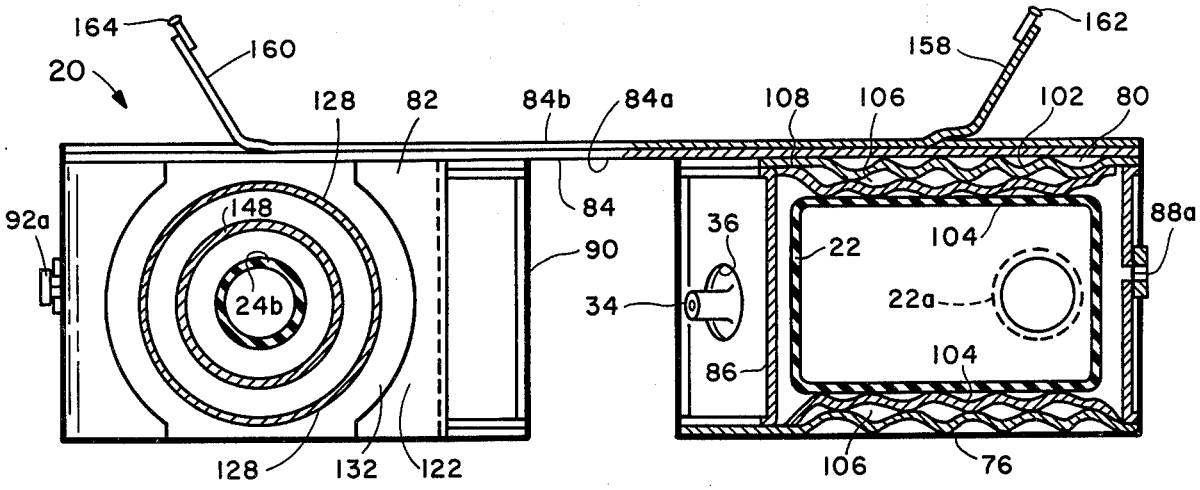
FIG. 7 is a sectional view taken substantially along line 7—7 of FIG. 4.

Similarly, and as best seen in FIG. 7, the front and rear walls 76,80 of the section 72 are formed of outer and inner layers 102,104 that are sealed together at numerous spaced locations to define water passages 106. The inner and outer layers of the front and rear walls of each section are further sealed together along boundary lines 108 of the pattern of dot seals.

Referring to FIG. 6, it can be seen that the outer and inner layers 94,96 of the sheath device section 74 are carried around the lower part of that section to form the bottom wall thereof and to define a water entry space 110 that receives heating water via a conduit 112. Similarly, with reference to FIG. 4, the outer and inner layers 102,104 are carried around the lower part of section 72 to form the bottom wall thereof and to define a water entry space 114 that receives heating water via a conduit 116. The conduits 114 and 116 are connected together and to water supply tube 66 by a tee 118 to form a manifold by which heating water is provided to each of the sheath device sections 72, 74. The outer layers 94 and 102 are each provided with an opening 119 outside of the boundaries 108 at the bottom of the respective sections to permit flooding and draining of the sheath device interior.

Figure 1:
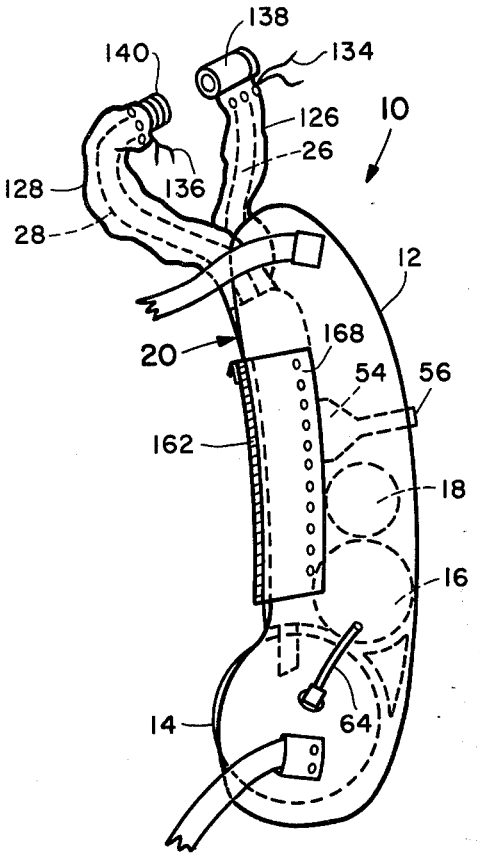
FIG. 1 is a side elevational view of an underwater breathing apparatus on which a heated breathing bag sheath device embodying the invention has been installed.
Figure 2:
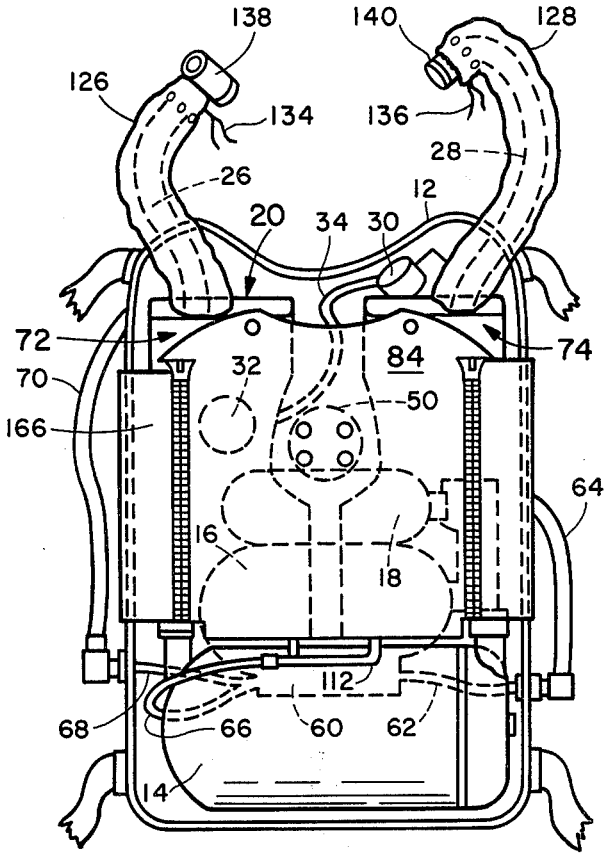
FIG. 2 is a front elevational view of the apparatus and sheath device of FIG. 1.
Figure 3:
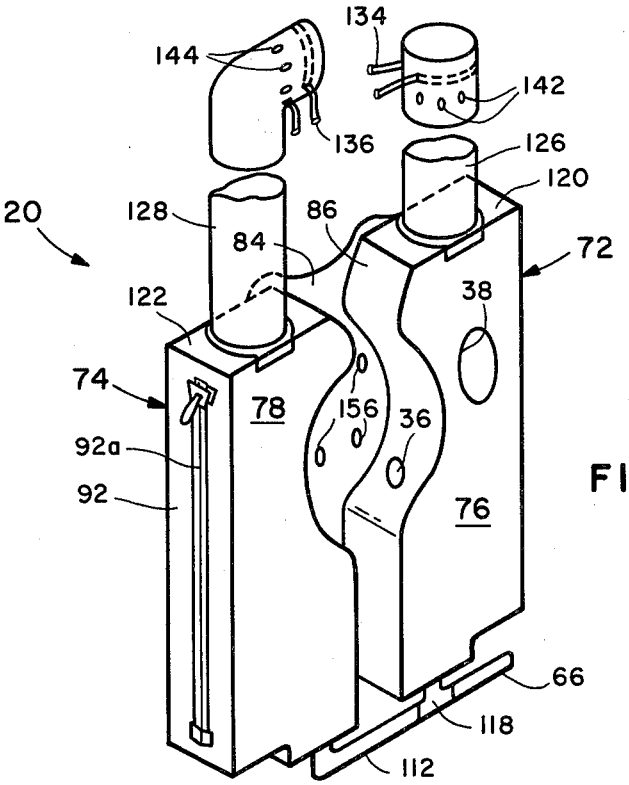
FIG. 3 is a perspective view illustrating the sheath device removed from the breathing apparatus.
Figure 5:
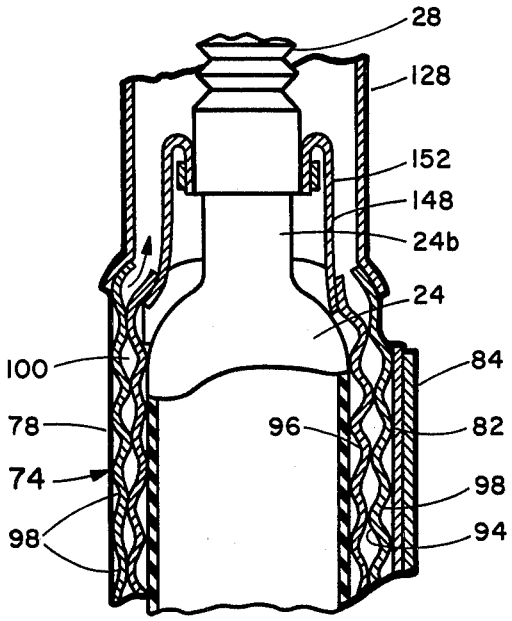
FIG. 5 is a fragmentary sectional view taken along line 5—5 of FIG. 4.

Referring now principally to FIGS. 3,4, and 5, the upper ends of the sections 72,74 are provided with upper end walls 120, 122 to which are attached water conducting sleeves 126,128, respectively, for conveying heating water along the flexible inhalation and exhalation hoses 26,28. The sleeves are formed of water impervious cloth and provided at their proximal ends with flanges 130,132 which are fixed in part to the upper walls 120,122, and in part to the outer layers 94 and 102 of the water conducting front and rear walls 76,80 and 78,82 of the sections 72,74.

The distal end portions of the sleeves 126,128 are provided with constricting means in the form of drawstrings 134,136 by which the sleeves are closed upon the end fittings 138,140 of the hoses 26,28. Adjacent the ends of the sleeves 126,128 inwardly of the drawstrings, the sleeves are provided with water discharge openings 142,144.

Located in the proximal end portions of the sleeves 126,128 are resiliently flexible skirt-like dams 146,148. As shown in FIGS. 4 and 5, the dams 146,148 each have an outwardly directed flange portion 150 fixed in part to the end walls 120,122 and in part to the inner layers 96,104 of the respective front and rear walls of the sheath device section 72,74. The purpose of the dams 146,148 is to direct water flowing upwardly from between the layers 94,96 and 102,104 into the spaces between the sleeves 126,128 and the respective hoses 26,28, while preventing heating water from flooding the spaces between the breathing bags 22,24 and the sheath inner wall surfaces. To this end, the end portions of the dams 146,148 remote from their connections to the sheath walls, are each secured by a clamp 152 to the base of the corresponding hose. This is conveniently accomplished during assembly with the dam turned down into the sheath device section and the appropriate hose fed from inside partially into the sleeve. After fitting the clamp 152, the insertion of the hose upwardly into the sleeve is completed, bringing the dam to the illustrated partially inverted condition.

The web 84 interconnecting the breathing bag containing sections 72,74 is conveniently formed of several fabric layers 84*a*, 84*b* and is provided with grommeted openings 156 for passing fasteners to secure the excess gas exhaust valve 54 in place. The back layer 84*b* conveniently terminates in edge flanges 158,160 carrying halves of slide fasteners 162,164 by which the sheath device 20 is secured to fabric panels 166,168 fixed to the sides of the shell 12.

In operation, hot water is forced through tube 66 and conduits 112,116 into the spaces 110,114 and thence upwardly between the layers of the front and walls of the sheath device sections 72,74, warming the breathing gas in the bags 22,24. The water then flows upwardly in the sleeves 126,128 heating the air passing through the hoses 26,28, and exiting through the openings 142,144 to the ambient water.

From the foregoing description, it will be recognized that the resultant benefits in diver comfort and duration of $CO_2$ scrubber efficiency are achieved by the novel sheath device construction without any substantial modification of the diving equipment with which it is used.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A heated sheath devide for use in association with an underwater breathing apparatus of the type including a breathing bag, a breathing hose extending from said bag for connection of its distal end to a utilization means, and a source of heated water, said sheath device comprising:

fabric wall means defining at least a first breathing bag enclosure;

said wall means comprising at least one wall including inner and outer layers of substantially water impervious fabric, said layers being connected together at a plurality of locations so as to define water flow passages in said one wall;

means for connecting said flow passages to said source of heated water;

at least a first water conducting, elongate sleeve means formed of substantially water impervious fabric having a proximal end connected to said outer layer of said wall means, said sleeve means being adapted to receive said hose and to have its distal end substantially closed about the distal end portion of said hose; and at least a first dam means extending from said inner layer and adapted to be fixed around the proximal end of said hose so as to direct water flowing from between said layers into the space between said hose and said sleeve means.

2. A sheath device as defined in claim 1, and wherein: said walls means comprises front and rear walls, each characterized by inner and outer layers connected together at a plurality of locations so as to define said water flow passages in each of said front and rear walls.

3. A sheath device as defined in claim 1, and wherein: said plurality of locations at which said layers are connected together to define said flow passages being characterized as boundary lines and a pattern of discrete dot-like connections between said boundary lines.

4. A sheath device as defined in claim 2, and wherein: said plurality of locations at which said layers are connected together to define said flow passages being characterized as boundary lines and a pattern of discrete dot-like connections between said boundary lines.

5. A sheath device as defined in claim 1, and comprising a second breathing bag enclosure, a second water conducting sleeve means, and a second dam means for association with a second breathing bag and breathing hose of said apparatus;

6. A sheath device as defined in claim 5, and wherein said first and second enclosures are joined in laterally spaced relation by a flexible fabric web, and said means for connecting said flow passages to said source comprises manifold means for directing heated water to the flow passages of each of said enclosures.

7. A sheath device as defined in claim 6, and wherein said first and second breathing bag enclosures are each characterized by an elongate opening in a side wall for inserting and removing a breathing bag, and closure means for selectively securing and securing said openings in closed condition.

8. A sheath device as defined in claim 7, and further comprising manually operable constriction effecting means adjacent said distal end portions of said sleeve means.

9. A sheath device as defined in claim 7, and wherein said water impervious fabric comprises polyurethane coated nylon cloth.

10. A sheath device as defined in claim 9, and further comprising:

first and second attachment panels adapted to be secured to said apparatus; and first and second slide fasteners releasably fastening said first and second breathing bag enclosures to said first and second attachment panels.

* * * * *